US008931313B2

(12) United States Patent
Lai

(10) Patent No.: US 8,931,313 B2
(45) Date of Patent: Jan. 13, 2015

(54) LOCK WITH DUAL LOCKING SYSTEM

(75) Inventor: Karl Lai, Hong Kong (HK)

(73) Assignee: The Sun Lock Company Ltd., Tuen Mun, NT (HK)

( * ) Notice: Subject to any disclaimer, the term of this patent is extended or adjusted under 35 U.S.C. 154(b) by 52 days.

(21) Appl. No.: 13/529,082

(22) Filed: Jun. 21, 2012

(65) Prior Publication Data

US 2013/0025333 A1 Jan. 31, 2013

Related U.S. Application Data

(60) Provisional application No. 61/572,989, filed on Jul. 25, 2011.

(51) Int. Cl.

| | |
|---|---|
| ***E05B 37/06*** | (2006.01) |
| ***E05B 35/10*** | (2006.01) |
| ***E05B 37/00*** | (2006.01) |
| ***E05B 37/02*** | (2006.01) |

(52) U.S. Cl.

CPC ..... *E05B 35/105* (2013.01); *E05B 37/0034* (2013.01); *E05B 37/025* (2013.01)

USPC ..... 70/21; 70/24; 70/25; 70/284; 70/285

(58) Field of Classification Search

CPC ..... E05B 35/105; E05B 37/0034; E05B 37/0058; E05B 35/10; E05B 47/0603; E05B 47/0642; E05B 47/068; E05B 65/52; E05B 37/0068; E05B 37/025; E05B 67/22; E05B 67/24

USPC ..... 70/21, 24–29, 284, 285

See application file for complete search history.

(56) References Cited

U.S. PATENT DOCUMENTS

| | | | | |
|---|---|---|---|---|
| 2,133,528 | A * | 10/1938 | Bell | 70/25 |
| 6,904,776 | B1 * | 6/2005 | Lin | 70/25 |
| 6,997,023 | B1 * | 2/2006 | Huang | 70/21 |
| 7,047,773 | B1 * | 5/2006 | Lin | 70/25 |
| 7,121,123 | B2 * | 10/2006 | Yu | 70/21 |
| 7,140,209 | B2 * | 11/2006 | Lai | 70/25 |
| 7,357,007 | B2 * | 4/2008 | Lin | 70/21 |
| 7,363,782 | B1 | 4/2008 | Misner et al. | |
| 7,523,628 | B2 * | 4/2009 | Yu | 70/21 |
| 7,698,913 | B2 * | 4/2010 | Lee | 70/21 |
| 7,779,657 | B2 * | 8/2010 | Yu | 70/21 |
| 8,011,212 | B2 * | 9/2011 | Yu | 70/21 |

(Continued)

FOREIGN PATENT DOCUMENTS

| | | |
|---|---|---|
| GB | 2451932 | 2/2009 |

*Primary Examiner* — Suzanne Barrett

(74) *Attorney, Agent, or Firm* — Ware, Fressola, Maguire & Barber LLP

(57) ABSTRACT

The present invention is directed to a padlock that includes a body and a shackle that has a toe portion and a heel portion. The shackle can be released from the body from a locked mode to a lock opened mode by upward movement of the shackle away from the body. The padlock also includes a combination locking mechanism configured to control the heel portion of the shackle when a correct combination is arranged on the combination locking mechanism. The combination locking mechanism may be reconfigured so that a new combination is entered for the combination locking mechanism. The padlock also includes a key locking mechanism that includes a cylinder operatively connected to a cam for controlling movement of the cam. The padlock may be placed in the lock opened mode by either the combination locking mechanism or the key locking mechanism.

20 Claims, 8 Drawing Sheets

(56) References Cited

U.S. PATENT DOCUMENTS

| | | | | |
|---|---|---|---|---|
| 8,171,760 | B2 * | 5/2012 | Yen et al. | 70/25 |
| 2005/0262902 | A1 * | 12/2005 | Ling et al. | 70/21 |
| 2006/0150690 | A1 * | 7/2006 | Lai et al. | 70/21 |
| 2006/0266084 | A1 | 11/2006 | Kuo et al. | |
| 2007/0227202 | A1 | 10/2007 | Yen et al. | |
| 2008/0011026 | A1 * | 1/2008 | Huang | 70/21 |
| 2008/0060390 | A1 * | 3/2008 | Yu et al. | 70/21 |
| 2008/0083251 | A1 * | 4/2008 | Lai et al. | 70/21 |
| 2008/0098774 | A1 | 5/2008 | Huang | |
| 2008/0223088 | A1 * | 9/2008 | Yang | 70/21 |
| 2008/0307839 | A1 * | 12/2008 | Yu | 70/330 |
| 2009/0031764 | A1 * | 2/2009 | Huang | 70/21 |
| 2010/0064738 | A1 | 3/2010 | Yi | |
| 2011/0079054 | A1 * | 4/2011 | Loughlin et al. | 70/21 |
| 2011/0289988 | A1 * | 12/2011 | Yu | 70/284 |
| 2013/0111958 | A1 * | 5/2013 | Kuo et al. | 70/21 |
| 2013/0118215 | A1 * | 5/2013 | Lai | 70/21 |

* cited by examiner 10
30
33
34
136
45
50
20
36
38

LOCK WITH DUAL LOCKING SYSTEM

CROSS-REFERENCE TO RELATED APPLICATIONS

This application claims priority to U.S. Provisional Appl. No. 61/572,989 filed Jul. 25, 2011, which is hereby incorporated by reference in its entirety.

BACKGROUND OF THE INVENTION

1. Field of the Invention

This invention relates to locks, and more particularly, to a lock with a dual locking system.

2. Description of Related Art

A number of padlock designs have been developed, and employed by individuals to prevent unauthorized persons from gaining access to any particular item or area which has been closed and locked. The padlock designs may include locks that are constructed to be opened by a key, or locks that are designed to be opened by knowledge of a particular combination.

A problem that has recently arisen, and affects both combination locks and key locks, is a requirement that all secured locks must be broken by inspection or security personal, for example Customs officers and Transportation Security Administration (TSA) officers, in order to gain access to containers, packages and/or luggage that may need to be inspected. In situations where all containers, packages and/or luggage must be scanned or inspected to prevent the transportation of potentially dangerous items or products which are deemed to be undesirable, the inspection and security personal may have the authority to open the luggage for visual inspection, which may include physically breaking any lock which may be on the container, package and/or luggage.

Consequently, lock systems that are incapable of being opened by inspection and security personnel are subject to be physically broken, in order to gain access to any container, package and/or luggage that needs to be visually inspected. As a result, owners of those containers, packages and/or luggage are faced with the possibility that any lock system employed to protect the contents of the containers, packages and/or luggage can be physically removed by inspection and security personnel, leaving the containers, packages and/or luggage completely unprotected during the remainder of the time that the containers, packages and/or luggage are outside of the possession and/or control of the owners.

SUMMARY OF THE INVENTION

The present invention is designed to overcome the above noted limitations that are attendant upon the use of conventional locks and, toward this end, it contemplates the provision of a uniquely constructed, lock with fully integrated dual locking system.

It is an object of the present invention to provide a lock with a dual locking system that can be opened and/or locked through the use of either locking system of the lock.

It is also an object that one of the locking systems of the lock of the present invention is a combination locking mechanism that permits changing the combination of the combination locking mechanism once the lock has been opened.

Still another object is to provide a lock that can allow inspection and/or security personal to open the lock without having to resort to destructive means in order to unlock the lock.

It is an additional object that inspection and/or security personal can open the lock through the use of a special key without having to resort to destructive means in order to unlock the lock.

Yet another object is to reduce the number of complaints received by owners of containers, packages and/or luggage whose locks have been destroyed as the result of inspect of the contents of their containers, packages and/or luggage.

A further object is to permit the lock to be reaffixed to containers, packages and/or luggage after inspection and/or security personal have inspected the contents of the containers, packages and/or luggage so that the containers, packages and/or luggage are not unsecured while out of the possession or control of the owners thereof.

It has now been found that the foregoing and related objects can be readily attained in a padlock having a dual locking system, in which the dual locking system includes a key locking mechanism and a combination locking mechanism. The key locking mechanism employs a latch plate member that is key controlled, and able to control the vertical movement of clutches and open a shackle of the padlock without the use of a combination locking mechanism of the padlock.

An exemplary embodiment of the present invention is directed to a padlock with dual locking mechanism which is enclosed in a lock body/housing. The lock can be opened by a combination and/or a key mechanism. The combination locking system is controlled by dials, and when the user of the lock has turned the dials to the preset lock-opened combination, an opening-gap of clutches will align with a protrusion of the shackle, which allows the user to lift the shackle and open the padlock. The key locking system may be controlled by a disc tumbler cylinder. As a correct key enters the disc tumbler cylinder, the cylinder turns and a cam above the cylinder will turn in the same manner. As the cam turns, the cam moves a latch plate in a direction substantially away from the clutches. As the latch plate moves, a spring underneath the clutches and a spacer ring push the set of clutches upward. As the clutches move upward, the shackle will move and the toe of the shackle will release out of the body of the lock.

In the locked mode, the combination is not aligned in the lock-opened combination. Therefore, an opening-gap of the clutch is not aligned with the protrusion of the shackle. Therefore, the shackle cannot be lifted upward. The protrusion of the shackle is in a locking-zone of the clutch. This will make the shackle stay in the locked position. In the locked mode, the key is not present and the cylinder and the cam cannot move the latch plate away from the clutches. Hence, the clutches cannot be pushed upward because the blocking-surface of the latch plate is in contact with the top surface of the clutch, which will not allow the shackle to be pushed upward. As the clutches cannot move vertically, the shackle cannot be pushed upward as well, and the toe of the shackle will remain in the toe-receiving-hole of the lock body/housing.

The dials have teeth that receive the extended fins of the clutch. They are engaged with each other during the unlock combination mode. When the dials are aligned to the open lock combination, the opening-gap of the clutch will align with the protrusion of the shackle. Since there is no wall in the clutch to block the protrusion, this allows the shackle to be able to be pulled upward. The shackle will be pulled upward until the double-protrusion of the shackle contacts the surface of the body. The protrusion of the shackle will now be on top of the lock-open-zone of the clutch. In this unlock by combination mode; the clutches have rotational movement and have no vertical (upward) movement. The shackle is the only component that has the vertical (upward) movement. The clutches have no vertical movement because the blocking-surface of the latch plate is blocking the top surface of the clutch which causes the clutch to not have any upward movement.

When the shackle is pulled upward in the unlock mode by using the combination locking mechanism, the shackle can rotate freely. The user can turn the shackle at pre-designated angle, for example clockwise approximately 90 degrees and push the shackle downward. As the shackle is pushed downward, the protrusion of the shackle is engaged in the slot of the clutch and can push the set of clutches downward. As the extended fin of each clutch is no longer engaged with the teeth of each dial, the user can turn the dial to their own combination. After the user sets the combination, the user can then release the shackle, and the spring underneath the spacer ring will push the spacer plate and the clutches upward. As the clutches move back to the original position, the extended fin of each clutch will engage back to the teeth of each of the corresponding dials.

When the key with correct cuts has been inserted into the cylinder, the cylinder is able to turn and the turning movement is transferred to the cam. An extended-fork of the cylinder may be engaged into a slot of the cam, and the cam is configured to move in the same manner. As the cam turns, an extended pin of the cam engages with a pin-receiving-slot of the latch plate, which makes the latch plate move in a direction away from the clutches. As the latch plate moves, the blocking-surface of the latch plate is no longer blocking a top surface of the top clutch, and the clutches will be pushed upward by the spring underneath the clutches and the spacer ring. Meanwhile, the dials and the clutches are not in the aligned position, therefore, the protrusion of the shackle is underneath of the locking-zone of the clutch. Given that the latch plate is not blocking the top surface of the top clutch, the spring underneath the clutches will push the set of clutches upward, and as the clutches moves upward, the shackle can be pushed or pulled upward until the protrusion of the shackle hits back the locking-zone of the clutch. In addition, the top surface of the clutch will move upward until it hits a surface on an interior region of the body. Since the shackle is being pushed upward, the toe of the shackle will release out of a toe-receiving-hole of the lock body/housing. In this unlock mode by use of the key, the clutches and the shackle have vertical (upward) movement.

An exemplary embodiment of the present invention is directed to a padlock that includes a body/housing and a shackle that has a toe portion and a heel portion. The body/housing includes holes to receive the toe of the shackle and the heel of the shackle. The heel portion of the shackle may be inside of the lock body/housing, and the toe may be moved away from the body/housing to a lock releasing position in which the lock is opened. The shackle can be released from the body/housing from a first position (the locked mode) to a second position (lock opened) by upward movement of the shackle away from the body/housing.

The padlock in accordance with the exemplary embodiment of the invention also includes a combination locking mechanism constructed in the body/housing, and configured to control the heel portion of the shackle when a correct combination is arranged on the combination locking mechanism. The combination locking mechanism includes one or more dials and one or more clutches, where each of the one or more clutches is operatively connected to one of the one or more dials, and the one or more clutches are configured to prevent the lock from being opened when the one or more dials are not set to display the combination for opening the lock using the combination locking mechanism.

The padlock in accordance with the exemplary embodiment of the invention also includes a key locking mechanism that includes a cylinder operatively connected to a cam for controlling movement of the cam. The key locking mechanism further includes a latch plate operatively connected to the cam, and configured to block the vertical movement of the one or more clutches. The latch plate is configured to resist the force exerted on the one or more clutches by a spring positioned so as to urge the one or more clutches in a vertical direction along the body of the lock. The vertical movement of the one or more clutches will help to push or pull the toe of the shackle out of the lock body/housing when the lock is opened by a key with correct cuts to allow for operative engagement with the key locking mechanism.

In the exemplary embodiment of the invention, the latch plate may have dual functions. The first function is to control the clutch not to have any vertical (upward) movement during the combination locking mode. The second function (for lock opened by key mode) is to move away from the clutch such that the clutch will move upward and causing the shackle to move upward to allow the toe of the shackle to be released out of the lock body/housing when the key locking mechanism is unlocked.

Another exemplary embodiment of the present invention is directed to a lock configured for operation between a locked configuration and an open configuration. The lock may include a body including a first surface with a toe receiving hole formed in the first surface, a shackle including a toe and a heel having a longitudinal axis and extending into and retained within the body, a first locking mechanism operatively connected to the shackle and configured for operation between a locked position and an unlocked position, and a second locking mechanism operatively connected to the shackle and configured for operation between a closed position and an open position.

In accordance with this exemplary embodiment of the present invention, the lock may be configured to be in the open configuration when either the first locking mechanism is in the unlocked position or the second locking mechanism is in the open position, and at least a portion of the toe is at least partially surrounded by the toe receiving hole when the lock is in the locked configuration.

In accordance with this exemplary embodiment of the present invention, the lock may also include at least one clutch positioned within the body and operatively connected to the first locking mechanism and/or the second locking mechanism.

In accordance with this exemplary embodiment of the present invention, the at least one clutch positioned within the body is operatively connected to the first locking mechanism.

In accordance with this exemplary embodiment of the present invention, the at least one clutch is operatively connected to a spring positioned within the body of the lock, and the spring is configured to urge the at least one clutch in a direction towards the latch plate along the longitudinal axis of the heel.

In accordance with this exemplary embodiment of the present invention, the at least one clutch may include a blocking ring extending from an interior surface of the at least one clutch, the heel may include at least one protrusion extending substantially perpendicular to the longitudinal axis of the heel, and the blocking ring is operatively engaged with the at least one protrusion so as to restrict movement of the heel in at least a first direction along the longitudinal axis of the heel.

In accordance with this exemplary embodiment of the present invention, the first locking mechanism may include a latch plate movable between a first position and a second position, and the first locking mechanism is in the locked position when the latch plate is in the first position and is in the unlocked position when the latch plate is in the second position.

In accordance with this exemplary embodiment of the present invention, when the latch plate is in the second position the spring is configured to move the at least one clutch along the longitudinal axis of the heel so that the blocking ring is positioned in a substantially spaced apart relationship from the at least one protrusion and the shackle is free to move rectilinearly along the longitudinal axis of the heel so that the toe of the shackle may be removed from the toe receiving hole.

In accordance with this exemplary embodiment of the present invention, the first locking mechanism may also include a cam operatively connected to the latch plate and configured to move the latch plate between the first position and the second position.

In accordance with this exemplary embodiment of the present invention, the cam is operatively connected to a key actuated cylinder configured to cause angular movement of the cam.

In accordance with this exemplary embodiment of the present invention, the key actuated cylinder may include a disc tumbler cylinder and at least one disc, and the cam is operatively connected to the disc tumbler cylinder.

In accordance with this exemplary embodiment of the present invention, the at least one clutch positioned within the body is operatively connected to the second locking mechanism.

In accordance with this exemplary embodiment of the present invention, the at least one clutch may include a substantially cylindrical member having a longitudinal axis and a bore through the longitudinal axis, and at least a portion of the heel of the shackle is positioned through the bore of the at least one clutch.

In accordance with this exemplary embodiment of the present invention, the bore of the at least one clutch is divided into a lock-open zone and a locking zone by a blocking ring extending from an interior surface of the at least one clutch.

In accordance with this exemplary embodiment of the present invention, the heel of the shackle may include at least one protrusion extending from the heel, and the blocking ring may include an opening gap defined therein and dimensioned so as to allow movement of the at least one protrusion between the locking zone and the lock-open zone.

In accordance with this exemplary embodiment of the present invention, the second locking mechanism is in the closed position when the at least one protrusion is positioned in the locking zone and in the open position when the at least one protrusion is positioned in the lock-open zone.

In accordance with this exemplary embodiment of the present invention, the second locking mechanism may include at least one dial positioned in the body and operatively connected to the at least one clutch.

In accordance with this exemplary embodiment of the present invention, the at least one dial is configured to rotate the at least one clutch about the longitudinal axis of the heel.

In accordance with this exemplary embodiment of the present invention, the at least one dial is configured to rotate the at least one clutch about the longitudinal axis of the heel so that the opening gap in the blocking ring is positioned in an aligned relationship to the at least one protrusion so as to allow rectilinear movement of the shackle along the longitudinal axis of the heel.

In accordance with this exemplary embodiment of the present invention, the rectilinear movement of the heel along the longitudinal axis permits removal of the toe from the toe receiving hole in the body so that the lock is in the open configuration, and when the lock is in the open configuration the shackle is configured to rotate about the longitudinal axis of the heel.

In accordance with this exemplary embodiment of the present invention, the at least one clutch may include an extended fin, and the at least one dial may include at least one tooth configured to operatively engage the extended fin of the at least one clutch so that rotational movement of the at least one dial is imparted to the at least one clutch.

In accordance with this exemplary embodiment of the present invention, the second locking mechanism is configured to be reconfigurable by disengaging the extended fin of the at least one clutch from the at least one tooth of the at least one dial so that the at least one dial is free to rotate without imparting rotational movement to the at least one clutch.

In accordance with this exemplary embodiment of the present invention, when the lock is in the open configuration the shackle is configured to rotate about the longitudinal axis of the heel and configured to disengage the extended fin of the at least one clutch from the at least one tooth of the at least one dial when moved in a direction towards the body of the lock.

The invention accordingly comprises the features construction, combination of elements and arrangements of parts which will be exemplified in the constructions hereinafter set forth.

BRIEF DESCRIPTION OF THE SEVERAL VIEWS OF THE DRAWINGS

For a fuller understanding of the nature and object of the present invention, reference should be had to the following detailed description taken in connection with the accompanying drawings, in which.

DETAILED DESCRIPTION OF THE INVENTION

Figures 1, 2, 3:
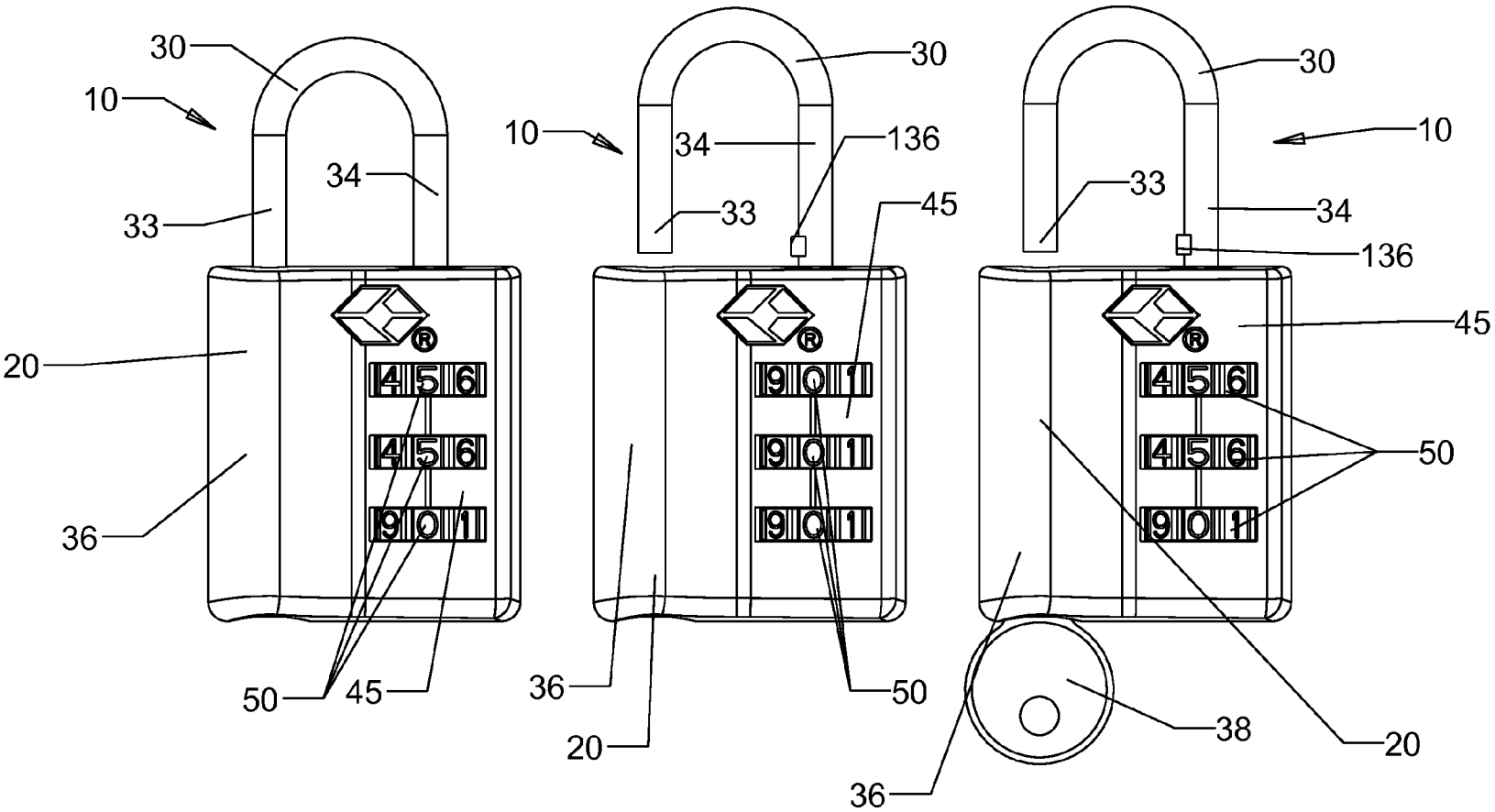
FIG. 1 is a front view of an exemplary lock in accordance with the present invention in a closed and locked state.
FIG. 2 a front view of the exemplary lock of the present invention in an open and unlocked state.
FIG. 3 is a front view of the exemplary lock of the present invention is the open and unlocked state.

The present invention now will be described more fully hereinafter with reference to the accompanying figures, in which exemplary embodiments of the invention are shown. The invention may, however, be embodied in many different forms and should not be construed as limited to the embodiments set forth herein. Like reference numerals refer to like elements throughout.

Figure 4:
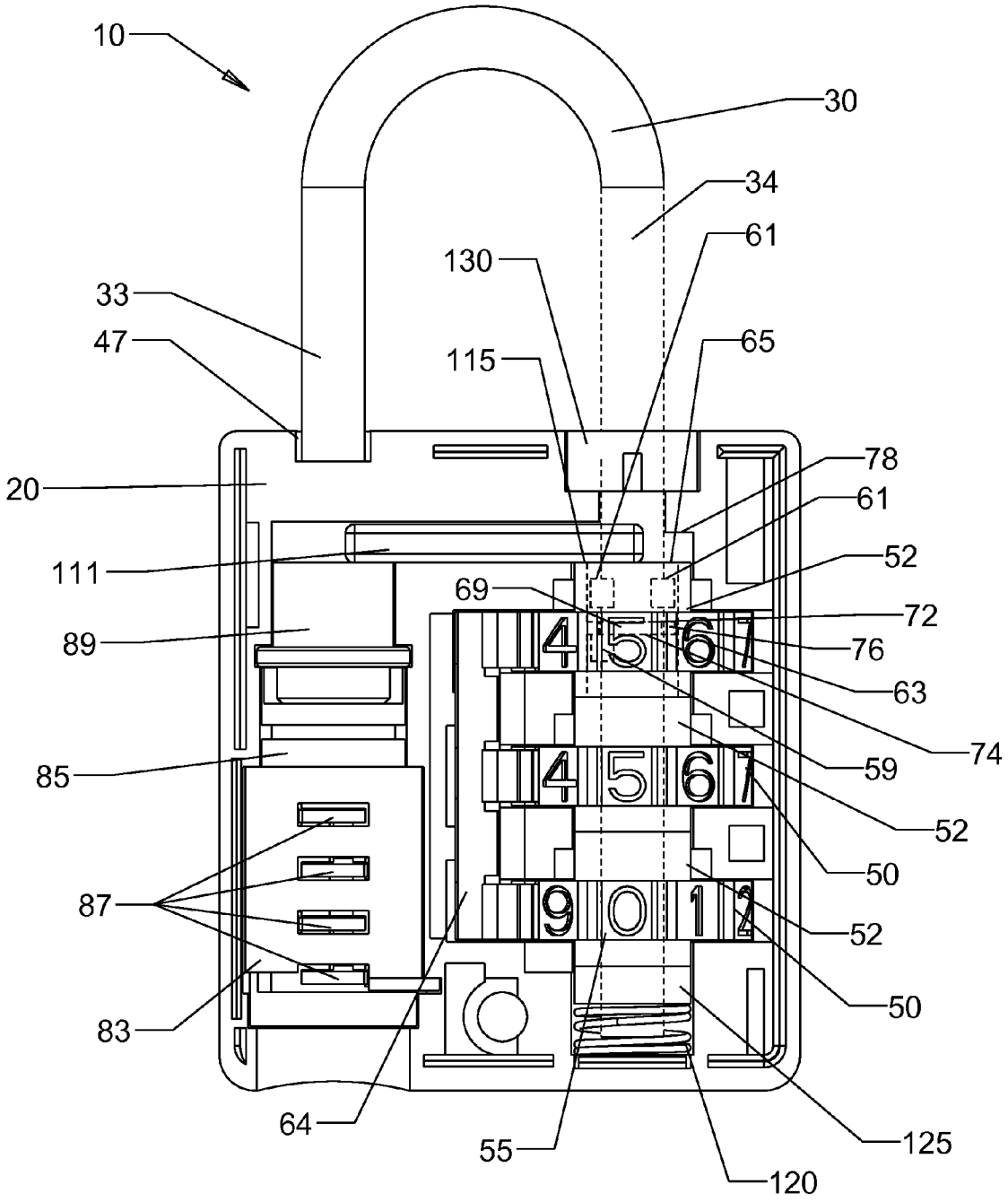
FIG. 4 is a front view of the exemplary lock of the present invention in which a portion of the body of the lock has been removed in order to show the internal components of the lock in the closed and locked state.

Referring first to FIGS. 1-3, therein illustrated is an exemplary padlock generally indicated by the numeral 10 of the present invention. The padlock 10 includes a body 20 and a shackle 30, and the shackle 30 includes a toe 33 and a heel 34. The heel 34 extends into, and is retained in the body 20. The padlock 10 also includes a key locking mechanism 36 that is configured to allow release of the toe 33 from the body 30 through the use of a key 38. The padlock 10 further includes a combination locking mechanism 45 that includes one or more dials 50, and configured to allow release of the toe 33 from the body 30 when a preset combination is set on the one or more dials 50. For example, as shown in FIG. 2, when the preset combination is set on the one or more dials 50 of the combination locking mechanism 45, the shackle 30 may be moved away from the body 20 thereby releasing the toe 33 from the body 20, and allowing the shackle 30 to be rotated (not shown) about the heel 34 of the shackle 30. Since the exemplary padlock 10 of the present invention includes a dual locking mechanism, the key locking mechanism 36 may also be used to release the toe 33 from the body 20, as shown for example in FIG. 3. Referring now to FIG. 4, a toe-receiving hole 47 is formed in the body 20 in order to retain the toe 33 of the shackle 30. The details and operation of the combination locking mechanism 45 and key locking mechanism 36 will be discussed more fully below.

Figure 5:
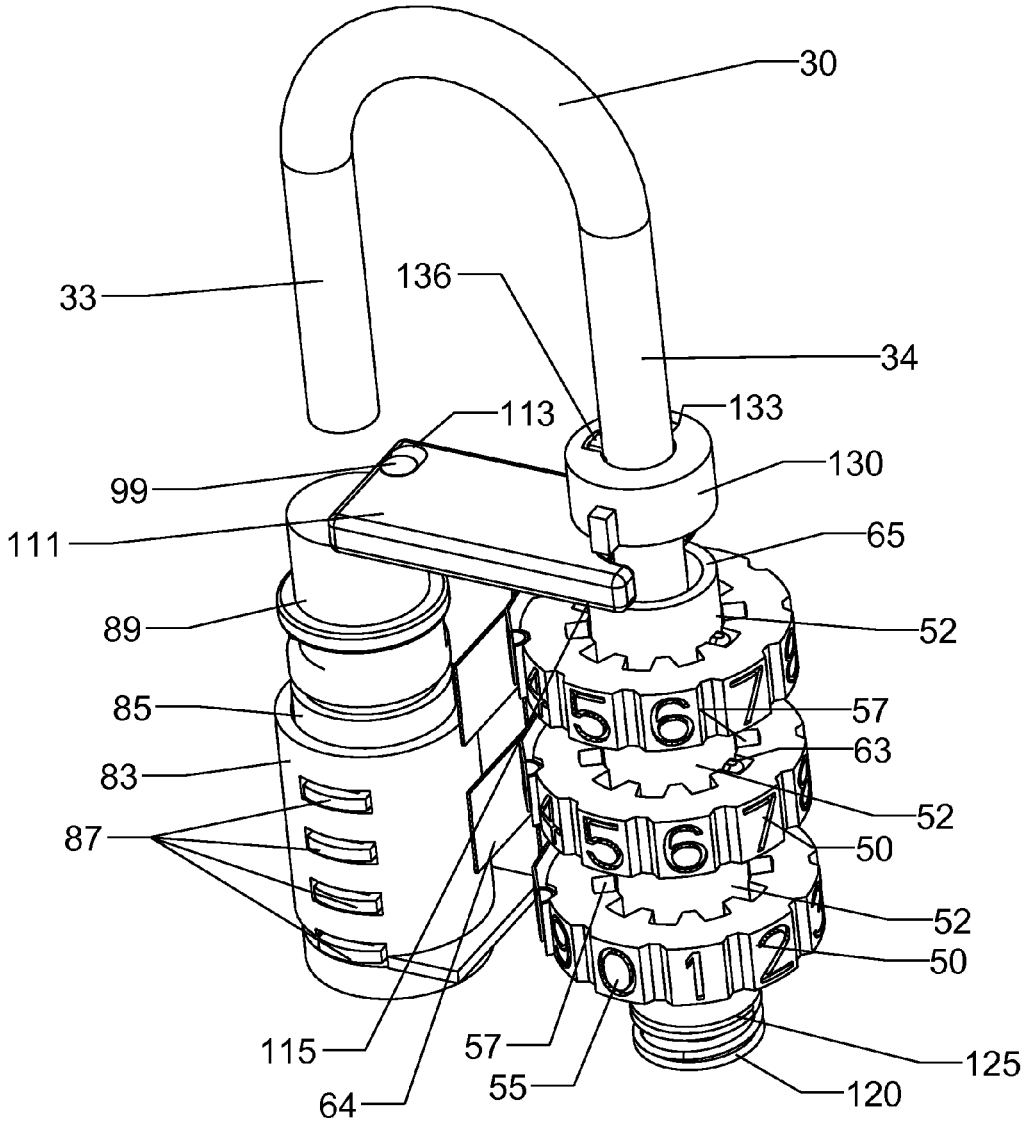
FIG. 5 is a perspective view of some of the components of the exemplary lock of the present invention.
Figure 14:
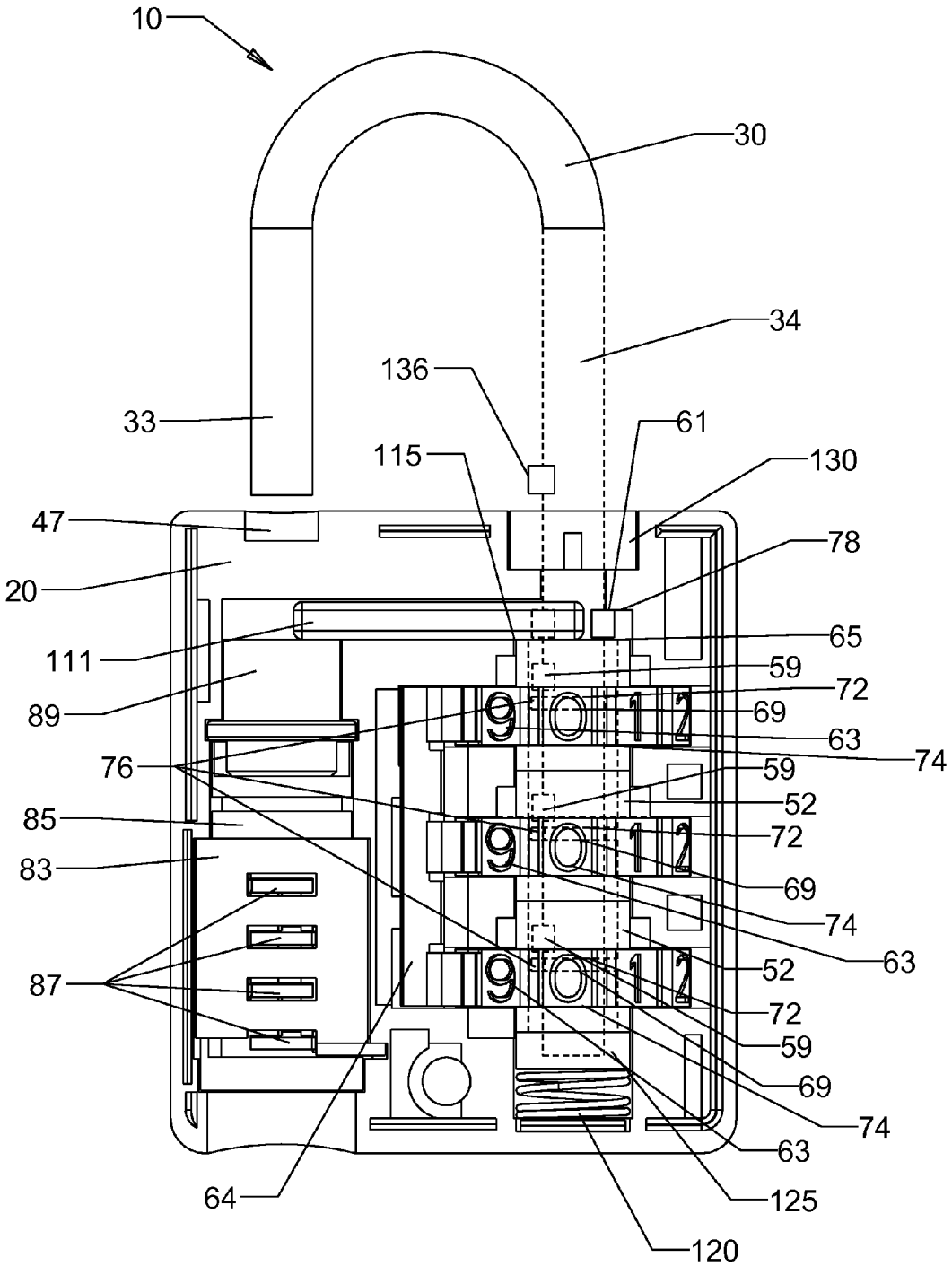
FIG. 14 is a front view of the exemplary lock of the present invention in which a portion of the body of the lock has been removed in order to show the internal components of the lock in the open and unlocked state.
Figure 15:
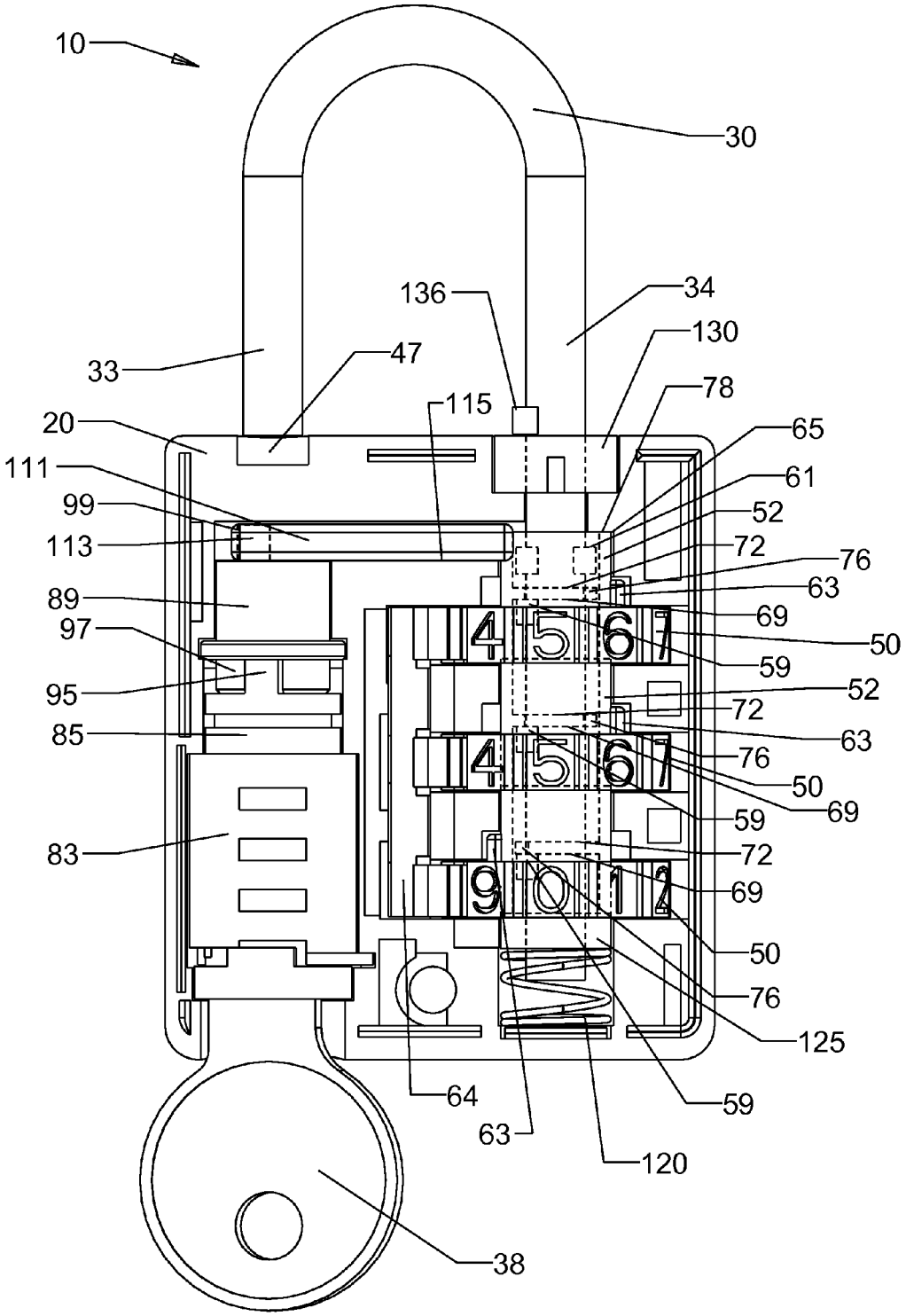
FIG. 15 is a front view of the exemplary lock of the present invention in which a portion of the body of the lock has been removed in order to show the internal components of the lock in the open and unlocked state.
Figure 17:
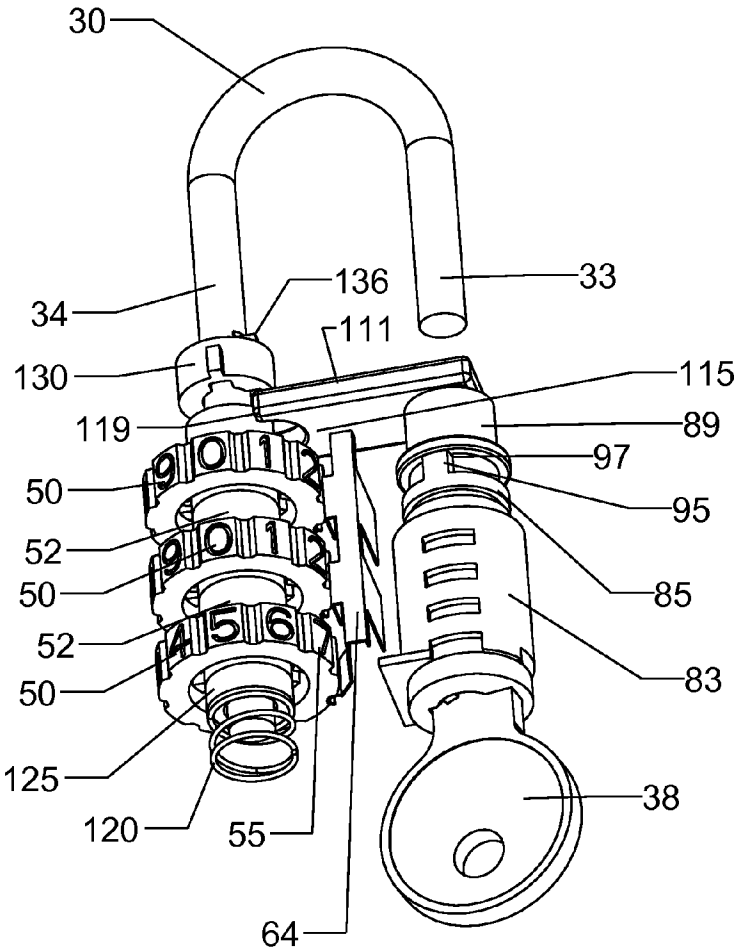
FIG. 17 is a back perspective view of some of the components of the exemplary lock of the present invention.
Figure 16:
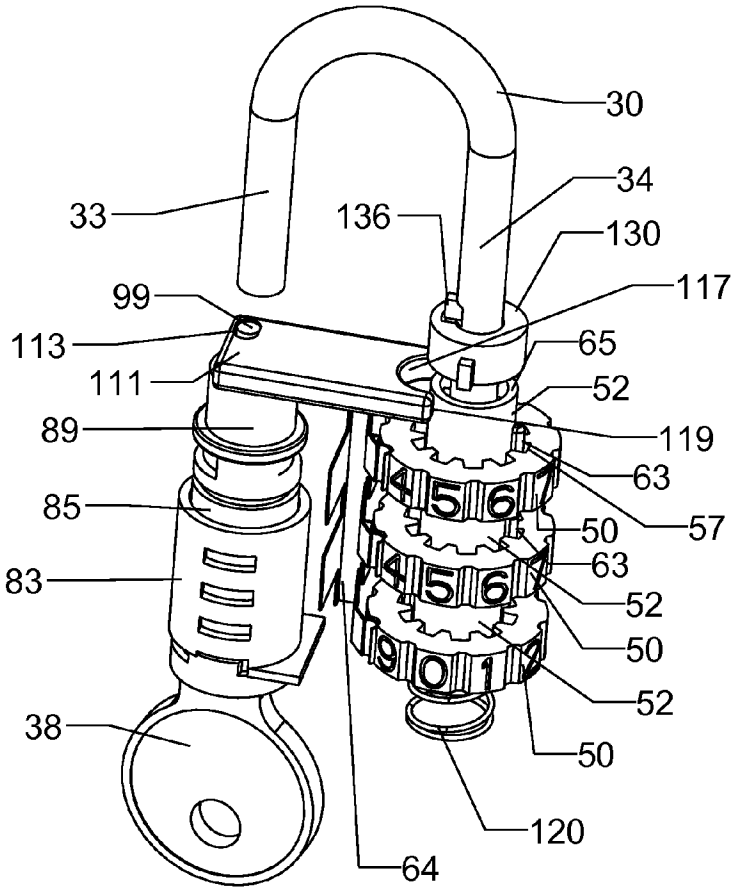
FIG. 16 is a front perspective view of some of the components of the exemplary lock of the present invention.

As shown in FIGS. 4, 5 and 14, each of the one or more dials 50 of the combination locking mechanism 45 is cooperatively associated with a clutch 52 positioned in surrounding relationship to a portion of the heel 34 of the shackle 30 that extends into the body 20 of the padlock 10. It is understood that one of the dials 50 has been left out of FIGS. 4 and 5 and all of the dials 50 have been left out of FIG. 14 in order to more clearly show the features positioned within and behind the dials 50, and that other components of the padlock 10 may not be shown in these figures so that the components shown in these figures are more clearly understood.

Figure 6:
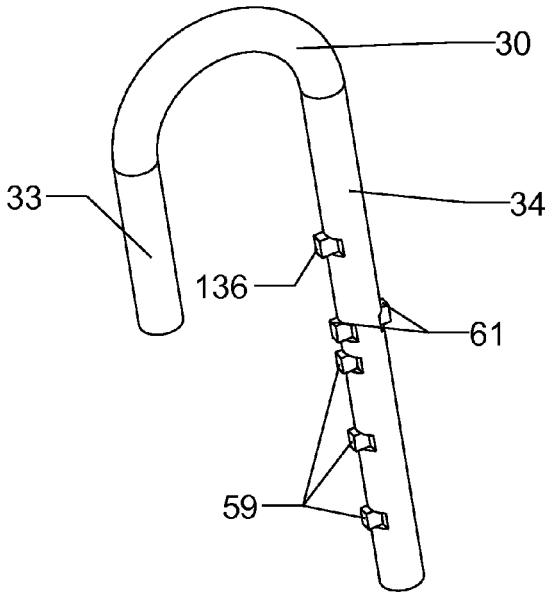
FIG. 6 is a perspective view of an exemplary shackle for use with the exemplary lock of the present invention.
Figure 9:
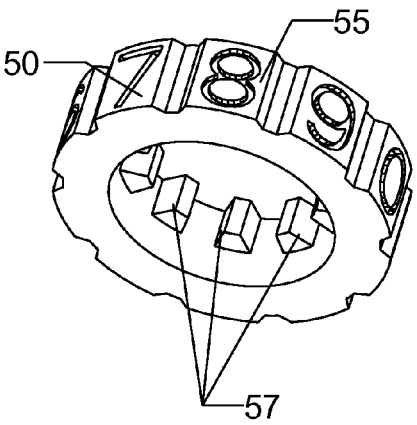
FIG. 9 is a bottom perspective view of an exemplary dial for use with the exemplary lock of the present invention.
Figure 10:
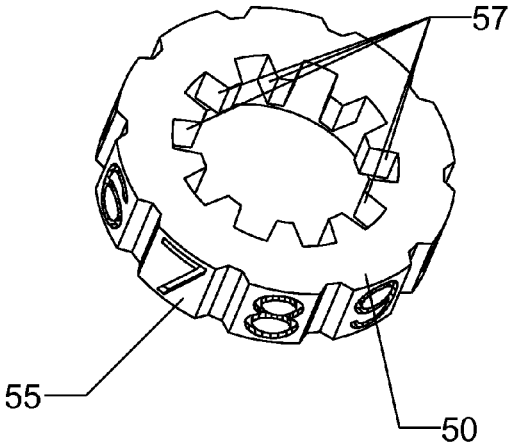
FIG. 10 is a top perspective view of the exemplary dial shown in FIG. 9.

As shown in detail in FIGS. 9 and 10, each of the one or more dials 50 includes one or more faces 55, on which numbers, letters, colors or other symbols may be printed, embossed or engraved in order to provide indicia for use with the combination locking mechanism 45. Each of the one or more dials 50 also includes one or more teeth 57 positioned on an interior surface of the dial 50 opposite the one or more faces 55. Referring again to FIGS. 4 and 14, the heel 34 of the shackle 30 includes one or more protrusions 59 that extend from the heel 34, and are positioned within the clutches 52. As shown in detail in FIG. 6, the protrusions 59 may be positioned in an aligned relationship on the heel 34 of the shackle 30, and the heel 34 may also include a double protrusion 61, in which a protrusion extends from opposing sides of the heel 34.

Referring again to FIGS. 4, 5 and 14, each of the one or more clutches 52 includes an extended fin 63 that extends from an outer surface of clutch 52, and is dimensioned to be positioned between two teeth 57 of one of the dials 50. The cooperative engagement of the extended fin 63 with the teeth 57 allows the clutch 52 to be rotated as the dial 50 engaged with the clutch 52 is rotated. Each of the dials 50 are engaged with a spring retaining clip 64 that provides resistance against each of the dials 50 so that a certain amount of force is required to overcome the resistance of the spring retaining clip 64 in order to rotate each of the dials 50. The spring retaining clip 64 is positioned within the body 20 of the padlock 10 so that each of the dials 50 can be rotated and held in discrete positions showing each one of the one or more faces 55 of the dials. In this manner, a combination using the dials 50 can be entered in the combination locking mechanism 45.

Figure 7:
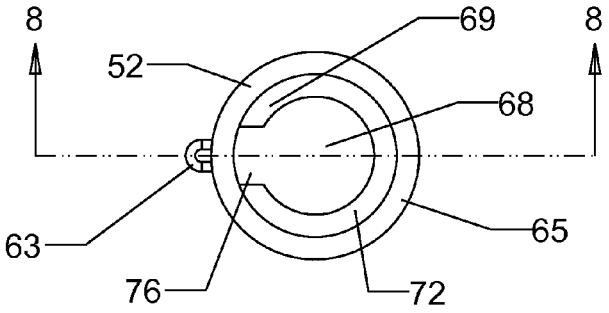
FIG. 7 is a top plan view of an exemplary clutch for use with the exemplary lock of the present invention.
Figure 8:
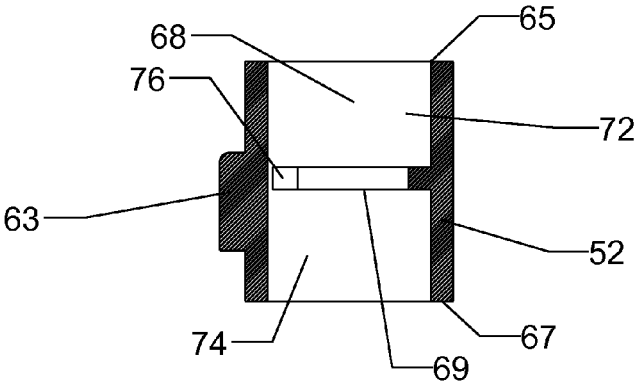
FIG. 8 is a cross-sectional view taken along line 8-8 of the exemplary clutch shown in FIG. 7.

As shown in greater detail in FIGS. 7 and 8, each of the clutches 52 includes a top surface 65 and a bottom surface 67. A bore 68 defining an interior region extends through the clutch 52 from the top surface 65 to the bottom surface 67. Positioned within the bore 68 in the interior region of the clutch 52 between the top surface 65 and the bottom surface 67 is a blocking ring 69 that substantially separates a lock-open zone 72 and a locking zone 74 of the clutch 52. An opening gap 76 is defined in the blocking ring 69 of the clutch 52. As shown in FIG. 14, the opening gap 76 allows for movement of the one or more protrusions 59 extending from the heel 34 of the shackle 30 between the locking zone 74 and the lock-open zone 72 of the clutch 52.

Referring again to FIG. 4, the body 20 includes a surface 78 positioned in an interior region of the body 20 that is configured to engage the double protrusion 61 extending from the heel 34 of the shackle 30 in order to ensure that the shackle 30 cannot be completely removed from the body 20 when the combination locking mechanism 45 is in an unlocked position.

Figure 11:
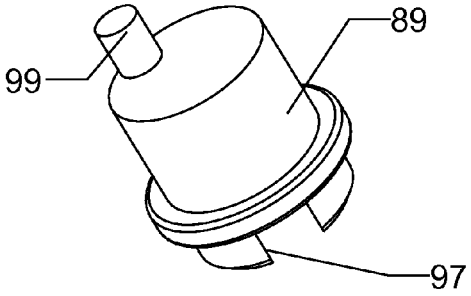
FIG. 11 is a perspective view of an exemplary cam for use with the exemplary lock of the present invention.
Figure 12:
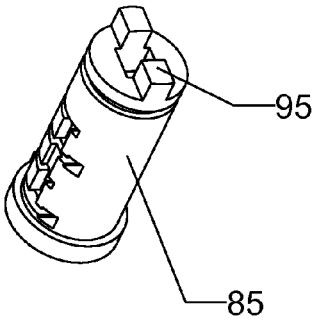
FIG. 12 is a perspective view of an exemplary disc tumbler cylinder for use with the exemplary lock of the present invention.
Figure 13:
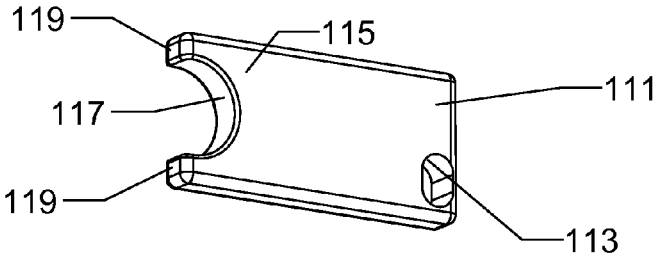
FIG. 13 is a perspective view of an exemplary latch plate for use with the exemplary lock of the present invention.

The components of the key locking mechanism 36 will now be discussed with reference to FIGS. 4, 5 and 15-17. The key locking mechanism 36 includes a disc tumbler lock 83 that includes a disc tumbler cylinder 85 and one or more discs 87. The disc tumbler cylinder 85 is configured to receive the key 38, and if the key 38 includes correct cuts (not shown) the discs 87 are moved and/or aligned so that rotation of the key 38 will cause rotation of the disc tumbler cylinder 85. The key locking mechanism 36 also includes a cam 89 operatively connected to the disc tumbler cylinder 85. As shown in FIGS. 11 and 12, the disc tumbler cylinder 85 includes an extended fork 95 extending from a surface of the disc tumbler cylinder 85, and configured to engage a slot 97 on the cam 89. As shown in FIG. 11, the cam 89 also includes an extended pin 99 extending from a surface of the cam 89, and positioned opposite to the slot 97. Referring again to FIGS. 4, 5 and 15-17, the key locking mechanism 36 also includes a latch plate 111 that includes a pin-receiving slot 113 for engaging the extended pin 99 of the cam 89. The latch plate 111 is shown in FIG. 13, and also includes a blocking surface 115 and a substantially semi-circular cutout 117 positioned on an end of the latch plate 111 opposite the pin-receiving slot 113. Positioned on either side of the substantially semi-circular cutout 117 are ends 119. Referring again to FIGS. 4 and 5, the blocking surface 115 is positioned in a blocking engagement with the top surface 65 of the top clutch 52 of the one or more clutches 52. In this engagement, the substantially semi-circular cutout 117 is positioned around a portion of the circumference of the heel 34 of the shackle 30. Positioned underneath the bottom clutch 52 of the one or more clutches 52 is a spring 120 and a spacer-ring 125 between the bottom clutch 52 and the spring 120. The blocking surface 115 acts to prevent the spring 120 from urging the one or more clutches 52 in a direction away from the spring 120.

As will be more fully discussed below, it is understood that the lock 10 may be opened by either of the combination locking mechanism 45 or the key locking mechanism 36. The locked configuration of the lock 10 is shown for example in FIG. 1, while the unlocked or opened configuration of the lock 10 is shown for example in FIGS. 2 and 3. In the locked configuration of the lock 10, the toe 33 of the shackle 30 is positioned so as to be retained in the toe-receiving hole 47, as shown for example in FIG. 4. In the unlocked/open configuration of the lock 10, the toe 33 of the shackle 30 is not positioned within the toe-receiving hole 47, as shown for example in FIGS. 14 and 15, so that the shackle 30 is free to rotate about the heel 34 (not shown).

Referring now to FIGS. 4, 5 and 14 for the operation of the combination locking mechanism 45, the padlock 10 is maintained in the locked configuration by the blocking ring 69 of the one or more clutches 52 preventing the protrusions 59 of the shackle 30 from moving in a direction that would cause release of the toe 33 from the toe-receiving hole 47. When the one or more dials 50 are positioned so that an incorrect combination is shown, the one or more clutches 52 are oriented so that the protrusions 59 of the shackle 30 are positioned in the locking zone 74 of the clutches 52. If the one or more dials 50 are rotated so that the correct combination is shown on the one or more dials 50, the rotation of each of the dials 50 causes rotation of the corresponding clutch 52 through the engagement of the teeth 57 of the dials 50 on the extended fins 63 of each clutch 52. In this manner, rotation of the one or more dials 50 is transferred to each of the one or more clutches 52. When the correct combination is displayed on the combination locking mechanism 45, the opening gap 76 of the blocking ring 69 of each clutch 52 is positioned in aligned relationship with the corresponding protrusions 59 of the shackle 30. This aligned relationship permits the shackle 30 to be pulled in a direction away from the body 20 of the padlock 10, so that the toe 33 of the shackle 30 can be removed from the toe-receiving hole 47. The shackle 30 may be pulled in the direction away from the body 20 until the double-protrusion 61 of the shackle 30 comes into contact with the surface 78 of the body 20. In this positioning, the protrusions 59 of the shackle 30 will be in the lock-open zones 72 of the clutches 52, as shown for example in FIG. 14. In order to put the padlock 10 back into its locked configuration, the toe 33 is aligned with the toe-receiving hole 47 and the shackle 30 is pushed in a direction towards the body 20 of the lock 10 thereby positioning the protrusions 59 in the locking zones 74 of the clutches 52. Once the toe 33 is within the toe-receiving hole 47, the dials 50 are rotated so that the clutches 52 are thereby rotated, and the opening gap 76 of the blocking ring 69 is no longer aligned with the protrusions 59 of the shackle 30, which thereby prevents movement of the shackle 30 away from the body 20.

It is possible for a user of the padlock 10 to reset the combination of the combination locking mechanism 45 once the padlock 10 is in the unlocked/open configuration. While the shackle 30 is pulled away from the body 20, the shackle 30 may be freely rotated about the longitudinal axis of the heel 34. The user may then rotate the shackle 30, and push the shackle 30 in the direction of the body 20, and as the shackle 30 is being pushed in this direction the protrusions 59 engage the blocking rings 69 of the clutches 52 to cause the clutches 52 to be pushed towards the bottom of the lock 10. As the clutches 52 are pushed in this direction the extended fins 63 disengage with the teeth 57 of the dials 50 so that the user can turn the dials 50 without rotating the clutches 52, and thereby set their own combination. Once the user has set a new combination, the user can then release the shackle 30, and the spring 120 will urge the spacer ring 125 and the clutches 52 upwards away from the bottom of the lock 10. As the clutches 52 move back to their original position, the extended fins 63 of the clutches 52 engage with the teeth 57 of the dials 50 so that the new combination can control the unlocking of the lock 10.

In order to facilitate resetting the combination of the combination locking mechanism 45 the padlock 10 may include an alignment ring 130 as shown in FIGS. 4-5 and 14-17. The alignment ring 130 includes a reconfigure cutout 133 as shown in FIG. 5. The reconfigure cutout 133 may be dimensioned to receive an aligning protrusion 136 extending from the heel 34 of the shackle 30 as shown in FIGS. 2-3, 5-6 and 14-17. The aligning protrusion 136 in cooperation with the reconfigure cutout 133 provide a guide to ensure that the shackle 30 is turned a sufficient amount so that the protrusions 59 engage the blocking rings 69 of the clutches 52, and do not pass through the opening gap 76 in the blocking rings 69. The aligning protrusion 136 in cooperation with the reconfigure cutout 133 may also help to ensure that the shackle 30 is not rotated once the shackle 30 is rotated so that the aligning protrusion 136 and reconfigure cutout 133 are aligned, and the shackle 30 is pressed in the direction towards the body 20 of the padlock 10. Once the aligning protrusion 136 is inserted into the reconfigure cutout 133 of the alignment ring 130 the shackle 30 can no longer be rotated, and this ensures that the clutches 52 are not rotated and thereby the opening gap 76 in each of the clutches 52 remained in an aligned configuration so that any combination now entered by the user on the dials 50 will become the new correction combination for the combination locking mechanism 45 once the shackle 30 is moved in a direction away from the body 20 of the padlock and the clutches 52 reengage with the dials 50.

Referring now to FIGS. 4 and 15-17, for the operation of the key locking mechanism 36 of the lock 10, the lock 10 is maintained in the locked configuration by the blocking surface 115 of the latch plate 111 preventing the spring 120 from urging the one or more clutches 52 in a direction that would allow the shackle 30 to move away from the body 20 thereby releasing the toe 33 from the toe-receiving hole 47. When a key 38 with the correct cuts (not shown) is inserted into the disc tumbler lock 83, the disc tumbler cylinder 85 may be rotated. Rotation of the disc tumbler cylinder 85 causes rotation of the cam 89, which thereby causes the extended pin 99 to act on the pin-receiving slot 113 to move the latch plate 111 in a direction substantially perpendicular to the longitudinal axis of the disc tumbler cylinder 85. This movement of the latch plate 111 causes the blocking surface 115 to move away from the top surface 65 of the top clutch 52 of the one or more clutches 52, as shown for example in FIG. 15. Since the one or more clutches 52 are no longer retained by the blocking surface 115, the spring 120 urges the spacer 125 away from the bottom of the lock 10, which thereby urges the one or more clutches 52 away from the bottom of the padlock 10 as well. This movement of the clutches 52 causes a separation between the protrusions 59 of the shackle 30 and the blocking rings 69 of the clutches 52, thereby allowing the shackle 30 to be pulled in a direction that allows removal of the toe 33 from the toe-receiving hole 47 of the body 20. The shackle 30 can be pulled in this direction until the protrusions 59 come back into contact with the blocking rings 69 of the clutches 52, and the one or more clutches 52 will be urged away from the bottom of the padlock 10 by the spring until the top surface 65 of the top clutch 52 comes into contact with the surface 78 of the body 20.

In order to place the padlock 10 back into the locked configuration, the toe 33 of the shackle 30 is aligned with the toe-receiving hole 47, and the shackle 30 is pushed in a direction so that the toe 33 is inserted into the toe-receiving hole 47. The key 38 is then turned to cause rotation of the disc tumbler cylinder 85 so that the cam 89 is rotated and the extended pin 99 acts on the pin-receiving slot 113 of the latch plate 111 to move the latch plate 111 so that the blocking surface 115 is positioned over the one or more clutches 52, thereby preventing upward movement of the one or more clutches 52. Once the key 38 is removed from the disc tumbler lock 83 the toe 33 of the shackle 30 is retained in the toe-receiving hole 47, and the key locking mechanism 36 is in the locked configuration.

It is understood that any of the components of the padlock 10 may be made from any suitable materials, such as metal or sufficiently durable plastics.

It will thus be seen that the objects set forth above, among those made apparent from the preceding description, are efficiently attained and, since certain changes may be made in the above article without departing from the scope of this invention, it is intended that all matter contained in this disclosure or shown in the accompanying drawings, shall be interpreted, as illustrative and not in a limiting sense.

It is to be understood that all of the present figures, and the accompanying narrative discussions of corresponding embodiments, do not purport to be completely rigorous treatments of the invention under consideration. It is to be understood that the above-described arrangements are only illustrative of the application of the principles of the present invention. Numerous modifications and alternative arrangements may be devised by those skilled in the art without departing from the scope of the present invention.

What is claimed is:

1. A lock configured for operation between a locked configuration and an open configuration, comprising:

a body comprising a first surface with a toe receiving hole formed in the first surface;

a shackle comprising a toe and a heel having a longitudinal axis and extending into and retained within the body;

a first locking mechanism comprising a latch plate operatively connected to the shackle, wherein the first locking mechanism is configured for operation between a locked position in which the latch plate restricts rectilinear movement of the shackle along the longitudinal axis of the heel of the shackle, and an unlocked position in which the latch plate is spaced away from the shackle to permit rectilinear movement of the shackle along the longitudinal axis of the heel of the shackle; and a second locking mechanism comprising at least one clutch operatively connected to the shackle and configured for operation between a closed position in which the at least one clutch restricts rectilinear movement of the shackle along the longitudinal axis of the heel of the shackle, and an open position in which the least one clutch is positioned so as to permit rectilinear movement of the shackle along the longitudinal axis of the heel of the shackle;

wherein the at least one clutch comprises a substantially cylindrical member having a longitudinal axis and a bore through the longitudinal axis divided into a lock-open zone and a locking zone by a blocking ring extending from an interior surface of the at least one clutch;

wherein at least a portion of the heel of the shackle is positioned through the bore of the at least one clutch;

wherein the lock is configured to be in the open configuration as a result of rectilinear movement of the shackle along the longitudinal axis of the heel of the shackle when the first locking mechanism is in the unlocked position;

wherein the lock is configured to be in the open configuration as a result of rectilinear movement of the shackle along the longitudinal axis of the heel of the shackle when the second locking mechanism is in the open position;

wherein the lock is configured to be in the open configuration when either of the first locking mechanism is in the unlocked position or the second locking mechanism is in the open position and the shackle is moved rectilinearly along the longitudinal axis of the heel of the shackle; and wherein at least a portion of the toe is at least partially surrounded by the toe receiving hole when the lock is in the locked configuration.

2. The lock according to claim 1, wherein the latch plate is movable between a first position in which the latch plate restricts rectilinear movement of the shackle and a second position in which the latch plate is spaced away from the shackle, and wherein the first locking mechanism is in the locked position when the latch plate is in the first position and is in the unlocked position when the latch plate is in the second position.

3. The lock according to claim 1, wherein the at least one clutch is operatively connected to a spring positioned within the body of the lock, and wherein the spring is configured to urge the at least one clutch in a direction towards the latch plate along the longitudinal axis of the heel of the shackle.

4. The lock according to claim 3, wherein the heel comprises at least one protrusion extending substantially perpendicular to the longitudinal axis of the heel; and wherein the blocking ring is operatively engaged with the at least one protrusion so as to restrict movement of the heel in at least a first direction along the longitudinal axis of the heel.

5. The lock according to claim 4, wherein when the latch plate is in the second position the spring is configured to move the at least one clutch along the longitudinal axis of the heel so that the blocking ring is positioned in a substantially spaced apart relationship from the at least one protrusion and the shackle is free to move rectilinearly along the longitudinal axis of the heel so that the toe of the shackle may be removed from the toe receiving hole.

6. The lock according to claim 2, wherein the first locking mechanism further includes a cam operatively connected to the latch plate and configured to move the latch plate between the first position and the second position.

7. The lock according to claim 6, wherein the cam is operatively connected to a key actuated cylinder configured to cause angular movement of the cam.

8. The lock according to claim 7, wherein the key actuated cylinder comprises a disc tumbler cylinder and at least one disc, and wherein the cam is operatively connected to the disc tumbler cylinder.

9. The lock according to claim 1, wherein the heel of the shackle comprises at least one protrusion extending from the heel, and wherein the blocking ring comprises an opening gap defined therein and dimensioned so as to allow movement of the at least one protrusion between the locking zone and the lock-open zone.

10. The lock according to claim 9, wherein the second locking mechanism is in the closed position when the at least one protrusion is positioned in the locking zone and in the open position when the at least one protrusion is positioned in the lock-open zone.

11. The lock according to claim 9, wherein the second locking mechanism comprises at least one dial positioned in the body and operatively connected to the at least one clutch, wherein the at least one dial is configured to rotate the at least one clutch about the longitudinal axis of the heel.

12. The lock according to claim 11, wherein the at least one dial is configured to rotate the at least one clutch about the longitudinal axis of the heel so that the opening gap in the blocking ring is positioned in an aligned relationship to the at least one protrusion so as to allow rectilinear movement of the shackle along the longitudinal axis of the heel.

13. The lock according to claim 12, wherein the rectilinear movement of the heel along the longitudinal axis permits removal of the toe from the toe receiving hole in the body so that the lock is in the open configuration, and wherein when the lock is in the open configuration the shackle is configured to rotate about the longitudinal axis of the heel.

14. The lock according to claim 11, wherein the at least one clutch comprises an extended fin, and the at least one dial comprises at least one tooth configured to operatively engage the extended fin of the at least one clutch so that rotational movement of the at least one dial is imparted to the at least one clutch.

15. The lock according to claim 14, wherein the second locking mechanism is configured to be reconfigurable by disengaging the extended fin of the at least one clutch from the at least one tooth of the at least one dial so that the at least one dial is free to rotate without imparting rotational movement to the at least one clutch.

16. The lock according to claim 15, wherein when the lock is in the open configuration the shackle is configured to rotate about the longitudinal axis of the heel and configured to disengage the extended fin of the at least one clutch from the at least one tooth of the at least one dial when moved in a direction towards the body of the lock.

17. A lock configured for operation between a locked configuration and an open configuration, comprising:

a body comprising a first surface with a toe receiving hole formed in the first surface;

a shackle comprising a toe and a heel having a longitudinal axis and least one protrusion extending substantially perpendicular to the longitudinal axis of the heel, wherein the heel extends into and is retained within the body;

a first locking mechanism comprising a latch plate operatively connected to the shackle, wherein the first locking mechanism is configured for operation between a locked position in which the latch plate restricts rectilinear movement of the shackle along the longitudinal axis of the heel of the shackle, and an unlocked position in which the latch plate is spaced away from the shackle to permit rectilinear movement of the shackle along the longitudinal axis of the heel of the shackle;

a second locking mechanism comprising at least one clutch operatively connected to the shackle and configured for operation between a closed position in which the at least one clutch restricts rectilinear movement of the shackle along the longitudinal axis of the heel of the shackle, and an open position in which the least one clutch is positioned so as to permit rectilinear movement of the shackle along the longitudinal axis of the heel of the shackle; and a spring positioned within the body of the lock, and configured to urge the at least one clutch in a direction towards the latch plate along the longitudinal axis of the heel of the shackle;

wherein the at least one clutch comprises a blocking ring extending from an interior surface of the at least one clutch and operatively engaged with the at least one protrusion so as to restrict movement of the heel in at least a first direction along the longitudinal axis of the heel;

wherein the lock is configured to be in the open configuration as a result of rectilinear movement of the shackle along the longitudinal axis of the heel of the shackle when the first locking mechanism is in the unlocked position;

wherein the lock is configured to be in the open configuration as a result of rectilinear movement of the shackle along the longitudinal axis of the heel of the shackle when the second locking mechanism is in the open position;

wherein the lock is configured to be in the open configuration when either of the first locking mechanism is in the unlocked position or the second locking mechanism is in the open position and the shackle is moved rectilinearly along the longitudinal axis of the heel of the shackle; and wherein at least a portion of the toe is at least partially surrounded by the toe receiving hole when the lock is in the locked configuration.

18. The lock according to claim 17, wherein when the latch plate is in the second position the spring is configured to move the at least one clutch along the longitudinal axis of the heel so that the blocking ring is positioned in a substantially spaced apart relationship from the at least one protrusion and the shackle is free to move rectilinearly along the longitudinal axis of the heel so that the toe of the shackle may be removed from the toe receiving hole.

19. The lock according to claim 17, wherein the latch plate is movable between a first position in which the latch plate restricts rectilinear movement of the shackle and a second position in which the latch plate is spaced away from the shackle, and wherein the first locking mechanism is in the locked position when the latch plate is in the first position and is in the unlocked position when the latch plate is in the second position.

20. The lock according to claim 19, wherein the first locking mechanism further includes a cam operatively connected to the latch plate and configured to move the latch plate between the first position and the second position.

* * * * *